US011467534B2

(12) United States Patent
Choi et al.

(10) Patent No.: US 11,467,534 B2
(45) Date of Patent: Oct. 11, 2022

(54) COOLING AND AIR PURIFYING STRUCTURE OF IMAGE FORMING APPARATUS

(71) Applicant: Hewlett-Packard Development Company, L.P., Spring, TX (US)

(72) Inventors: Jaewon Choi, Pangyo (KR); JeongYong Ju, Pangyo (KR); Yunsung Lee, Pangyo (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/417,019

(22) PCT Filed: Jan. 13, 2020

(86) PCT No.: PCT/US2020/013307

§ 371 (c)(1),
(2) Date: Jun. 21, 2021

(87) PCT Pub. No.: WO2021/011028

PCT Pub. Date: Jan. 21, 2021

(65) Prior Publication Data

US 2022/0137552 A1 May 5, 2022

(30) Foreign Application Priority Data

Jul. 17, 2019 (KR) ..... 10-2019-0086150

(51) Int. Cl.

| | |
|---|---|
| ***G03G 21/00*** | (2006.01) |
| ***G03G 21/20*** | (2006.01) |
| ***B41J 29/377*** | (2006.01) |
| *G03G 15/20* | (2006.01) |

(52) U.S. Cl.

CPC ..... *G03G 21/206* (2013.01); *B41J 29/377* (2013.01); *G03G 15/201* (2013.01); *G03G 2221/1645* (2013.01)

(58) Field of Classification Search

CPC ..... G03G 21/206; G03G 2221/1645; B41J 29/377

USPC ..... 399/92, 93

See application file for complete search history.

(56) References Cited

U.S. PATENT DOCUMENTS

| | | | | |
|---|---|---|---|---|
| 7,603,050 | B2 * | 10/2009 | Kim | G03G 21/206 399/92 |
| 2006/0039716 | A1 * | 2/2006 | Sahara | G03G 15/2021 399/92 |
| 2008/0217556 | A1 * | 9/2008 | Kagawa | A61L 9/22 250/423 R |

(Continued)

FOREIGN PATENT DOCUMENTS

| | | |
|---|---|---|
| JP | 2002365986 | 12/2002 |
| JP | 2003307915 | 10/2003 |

(Continued)

*Primary Examiner* — Robert B Beatty

(74) *Attorney, Agent, or Firm* — Jefferson IP Law, LLP

(57) ABSTRACT

An example image forming apparatus includes an image forming unit to form a toner image on a print medium, a fusing unit to fix the toner image to the print medium, a duct comprising an air inlet located adjacent to an exit of the fusing unit and an air discharge outlet located toward a discharge outlet through which the print medium is discharged, and a blower provided in the duct to discharge air to the air discharge outlet.

20 Claims, 11 Drawing Sheets

(56) References Cited

U.S. PATENT DOCUMENTS

| | | | | |
|---|---|---|---|---|
| 2008/0219695 | A1* | 9/2008 | Doshohda | G03G 21/206 399/93 |
| 2009/0277332 | A1 | 11/2009 | Tanaka et al. | |
| 2011/0085819 | A1 | 4/2011 | Akagawa | |
| 2011/0142482 | A1* | 6/2011 | Nakashima | G03G 21/206 399/361 |
| 2011/0255895 | A1* | 10/2011 | Kim | G03G 15/2017 399/92 |
| 2012/0070215 | A1* | 3/2012 | Murakami | G03G 15/6573 399/92 |
| 2013/0243471 | A1 | 9/2013 | Ikeda et al. | |
| 2014/0376949 | A1* | 12/2014 | Fujita | G03G 21/206 399/92 |
| 2015/0132020 | A1* | 5/2015 | Saito | G03G 15/2017 399/92 |
| 2015/0253716 | A1* | 9/2015 | Nagasako | B65H 29/125 271/306 |
| 2018/0024462 | A1* | 1/2018 | Shimada | G03G 15/051 399/92 |
| 2018/0239298 | A1 | 8/2018 | Yabuki et al. | |
| 2019/0212682 | A1* | 7/2019 | Kawasaki | G03G 15/6558 |
| 2019/0278222 | A1* | 9/2019 | Ishikawa | G03G 21/206 |
| 2020/0223652 | A1* | 7/2020 | Morita | B65H 29/247 |

FOREIGN PATENT DOCUMENTS

| | | | | |
|---|---|---|---|---|
| JP | 2006205700 | | 8/2006 | |
| JP | 2010234187 | A | 10/2010 | |
| JP | 2013195614 | | 9/2013 | |
| WO | WO-2019140069 | A1 * | 7/2019 | B41J 29/377 |

* cited by examiner

COOLING AND AIR PURIFYING STRUCTURE OF IMAGE FORMING APPARATUS

BACKGROUND

An electrophotographic image forming apparatus using toner such as a printer, a multi-function printer, a copier, a scanner, or a fax machine supplies toner to an electrostatic latent image formed on a photoconductor to form a visible toner image on the photoconductor, transfers the visible toner image directly or through an intermediate transfer medium to a print medium, and fixes the transferred toner image on the print medium.

Heat and pressure are applied to the print medium to which the toner is transferred during a fusing process. An internal temperature of the image forming apparatus may be increased due to the heat generated during the fusing process. The increased internal temperature of the image forming apparatus may generate condensation or fine dust (e.g., nanodust, ultrafine particles (UFP), etc.).

DETAILED DESCRIPTION OF EXAMPLES

Hereinafter, various examples will be described with reference to the accompanying drawings. The examples described below may be implemented while being modified into several different forms.

Figure 1:
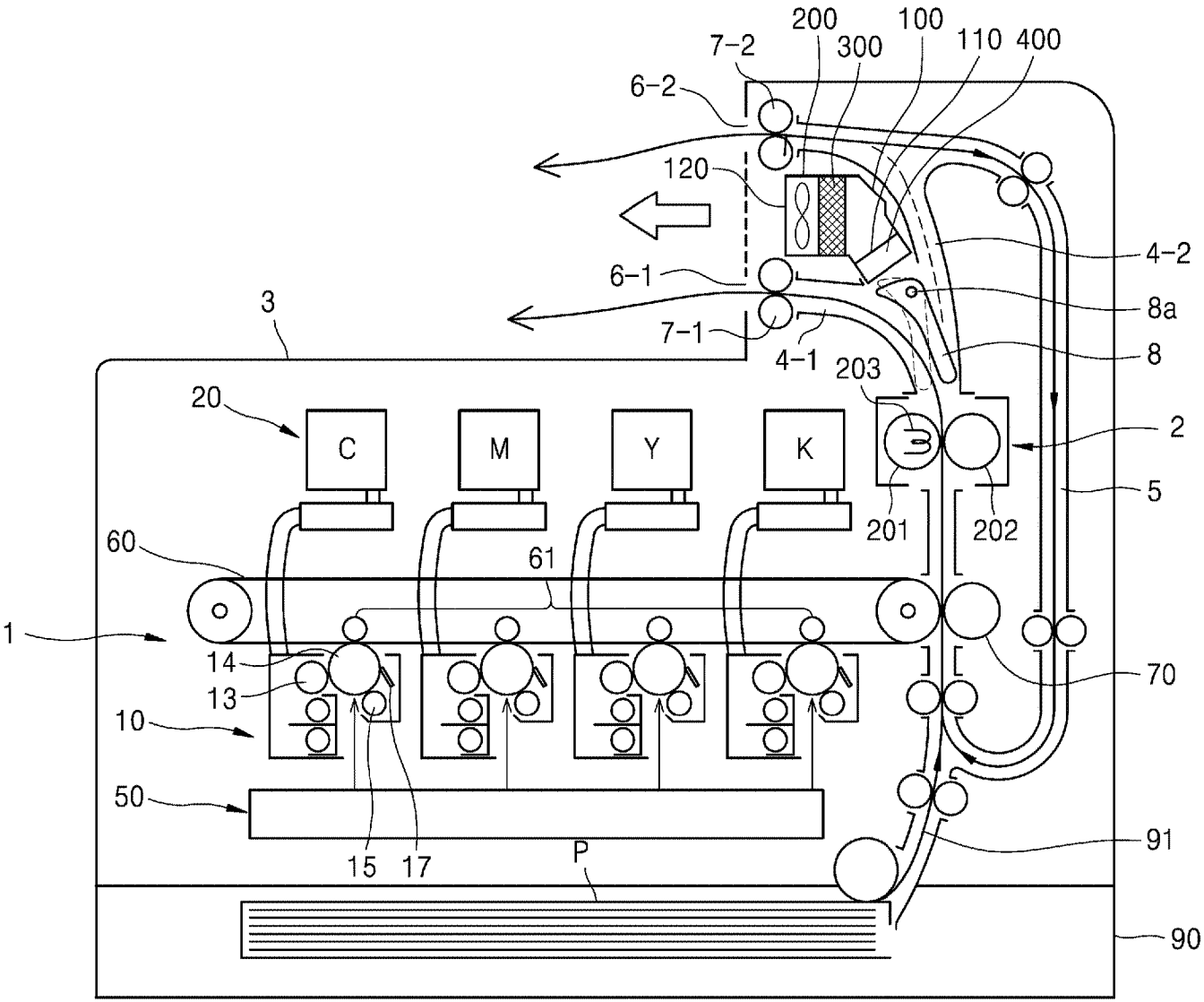
FIG. 1 is a view illustrating an electrophotographic image forming apparatus according to an example.

FIG. 1 is a view illustrating an electrophotographic image forming apparatus according to an example.

Referring to FIG. 1, the image forming apparatus may include an image forming unit 1 to form a toner image on a print medium P and a fusing unit 2 to fix the toner image to the print medium P.

The image forming unit 1 may form a color toner image on the print medium P by using an electrophotographic method. The image forming unit 1 may include a plurality of developing units 10, an exposure unit 50, and a transfer unit. A developer may be accommodated in each of the plurality of developing units 10 and may be supplied from a plurality of developer cartridges 20 to the plurality of developing units 10 respectively corresponding to the plurality of developer cartridges 20. The plurality of developing units 10 may include a plurality of developing units 10C, 10M, 10Y, and 10K for forming cyan (C), magenta (M), yellow (Y), and black (K) toner images. Reference numerals with letters C, M, Y, and K respectively denote elements for developing C, M, Y, and K developers unless specified otherwise.

Each of the developing units 10 may include a photosensitive drum 14 on a surface of which an electrostatic latent image is formed, and a developing roller 13 that supplies a developer to the electrostatic latent image and develops the electrostatic latent image into a visible toner image. The photosensitive drum 14, having a photoconductor on a surface of which an electrostatic latent image is formed, may include a conductive metal pipe and a photosensitive layer formed on an outer circumferential surface of the conductive metal pipe. A charging roller 15 is a charger for charging the photosensitive drum 14 to a uniform electric surface potential. A charging brush or a corona charger, instead of the charging roller 15, may be used. The developing unit 10 may further include a charging roller cleaner (not shown) for removing a foreign material such as dust or a developer attached to the charging roller 15, a cleaning member 17 for removing the developer remaining on the surface of the photosensitive drum 14 after an intermediate transfer process, and a regulating member (not shown) for regulating the amount of developer supplied to a development area where the photosensitive drum 14 and the developing roller 13 face each other. The cleaning member 17 may be a cleaning blade that contacts the surface of the photosensitive drum 14 and removes the developer. Although not shown in FIG. 1, the cleaning member 17 may be a cleaning brush that contacts the surface of the photosensitive drum 14 while rotating and removes the developer.

The developing roller 13 may be spaced apart from the photosensitive drum 14 and may rotate. The developing roller 13 may be a magnetic roller. The developing roller 13 may include a developing sleeve and a magnet fixedly (i.e., non-rotatably) located in the developing sleeve. Toner may be mixed with a magnetic carrier in the developing unit 10 and may be attached to a surface of the magnetic carrier. The magnetic carrier may be attached to a surface of the developing roller 13 and may be conveyed to the development area where the photosensitive drum 14 and the developing roller 13 face each other. The regulating member (not shown) regulates the amount of developer conveyed to the development area. Only toner is supplied to the photosensitive drum 14 due to a developing bias voltage applied between the developing roller 13 and the photosensitive drum 14, and an electrostatic latent image formed on the surface of the photosensitive drum 14 is developed into a visible toner image.

The exposure unit 50 forms an electrostatic latent image on the photosensitive drum 14 by emitting light modulated to correspond to image information to the photosensitive drum 14.

The transfer unit transfers a toner image formed on the photosensitive drum 14 to the print medium P. In an example, the transfer unit using an intermediate transfer method is used. For example, the transfer unit may include an intermediate transfer belt 60, a plurality of intermediate transfer rollers 61, and a transfer roller 70.

The intermediate transfer belt 60 temporarily accommodates toner images developed on the photosensitive drums 14 of the plurality of developing units 10C, 10M, 10Y, and 10K. The plurality of the intermediate transfer rollers 61 are located to face the photosensitive drums 14 of the plurality of developing units 10C, 10M, 10Y, and 10K with the intermediate transfer belt 60 therebetween. An intermediate transfer bias voltage for transferring the toner images developed on the photosensitive drums 14 to the intermediate transfer belt 60 is applied to the plurality of intermediate transfer rollers 61. A corona transfer unit or a transfer unit using a pin-scorotron method, instead of the intermediate transfer rollers 61, may be used.

The transfer roller 70 faces the intermediate transfer belt 60. A transfer bias voltage for transferring the toner images transferred to the intermediate transfer belt 60 to the print medium P is applied to the transfer roller 70.

In an example, the exposure unit 50 forms an electrostatic latent image on the photosensitive drums 14 by scanning lights modulated to correspond to color image information to the photosensitive drums 14 of the plurality of developing units 10C, 10M, 10Y, and 10K. The electrostatic latent images of the photosensitive drums 14 of the plurality of developing units 10C, 10M, 10Y, and 10K are developed into visible toner images due to C, M, Y, and K developers respectively supplied from the plurality of developer cartridges 20C, 20M, 20Y, and 20K to the plurality of developing units 10C, 10M, 10Y, and 10K. The developed toner images are sequentially transferred to the intermediate transfer belt 60. The print medium P stacked on a feeder 90 is fed along a feed path 91 into a nip between the transfer roller 70 and the intermediate transfer belt 60. The toner images transferred to the intermediate transfer belt 60 are transferred to the print medium P due to a transfer bias voltage applied to the transfer roller 70. Due to the above process, the image forming unit 1 forms a visible toner image on the print medium P.

The print medium P passing through the image forming unit 1 is fed to the fusing unit 2. The fusing unit 2 applies heat and pressure to a toner image transferred to the print medium P and fixes the toner image to the print medium P. The fusing unit 2 may have any of various structures. For example, as illustrated in FIG. 1, the fusing unit 2 may include a fusing roller 201, a pressing roller 202 engaged with the fusing roller 201 and forming a fusing nip, and a heater 203 heating the fusing roller 201. A structure of the fusing unit 2 is not limited to that of FIG. 1. For example, a fusing belt (not shown), instead of the fusing roller 201, may be used. When the print medium P passes through the fusing unit 2, the toner image is fixed to the print medium P due to heat and pressure.

The print medium P passing through the fusing unit 2 may be discharged to a tray 3 and may be re-supplied to the image forming unit 1 through a double-sided printing path 5. The double-sided printing path 5 is a path through which the print medium P on which single-sided printing is completed is inverted and is supplied to the image forming unit 1. The tray 3 may be located over the image forming unit 1.

The image forming apparatus may include a discharge outlet through which the print medium P may be discharged. The discharge outlet may include a first medium discharge outlet 6-1 and a second medium discharge outlet 6-2. The first medium discharge outlet 6-1 and the second medium discharge outlet 6-2 may be open toward the tray 3 and spaced apart from each other in a vertical direction. In the illustrated example, the second medium discharge outlet 6-2 is located over the first medium discharge outlet 6-1.

The print medium P passing through the fusing unit 2 may be discharged through the first medium discharge outlet 6-1 to the tray 3. A first feed path 4-1 guides the print medium P passing through the fusing unit 2 to the first medium discharge outlet 6-1. A first discharge roller 7-1 that feeds the print medium P may be provided at the first medium discharge outlet 6-1.

For double-sided printing, the print medium P passing through the fusing unit 2 may be temporarily discharged through the second medium discharge outlet 6-2 to the tray 3, and may be supplied to the double-sided printing path 5. A second feed path 4-2 is branched from the first feed path 4-1 to guide the print medium P passing through the fusing unit 2 to the second medium discharge outlet 6-2 located over the first medium discharge outlet 6-1. The second feed path 4-2 is connected to the double-sided printing path 5. A second discharge roller 7-2 that feeds the print medium P may be provided at the second medium discharge outlet 6-2. The print medium P on which single-sided printing is completed is temporarily discharged through the second medium discharge outlet 6-2 toward the tray 3. The second discharge roller 7-2 is reversely rotated before an end of the print medium P passes through the second discharge roller 7-2. The print medium P is fed to the double-sided printing path 5. In this process, the print medium P having a first surface on which single-sided printing is completed may be inverted so that a second surface opposite to the first surface faces the intermediate transfer belt 60 and may be supplied to the image forming unit 1.

A guide member 8 is located at an exit of the fusing unit 2 and selectively guides the print medium P to the first feed path 4-1 or the second feed path 4-2. The guide member 8 may have a first position (marked by a solid line in FIG. 1) that guides the print medium P to the first feed path 4-1 and a second position (marked by a dashed line in FIG. 1) that guides the print medium P to the second feed path 4-2. For example, the guide member 8 may pivot between the first position and the second position about a hinge 8*a*. For example, a solenoid (not shown) may be used as an actuator that switches the guide member 8 between the first position and the second position. A controller (not shown) may control the solenoid to locate the guide member 8 at the first position for single-sided printing and may control the solenoid to locate the guide member 8 at the second position for double-sided printing.

The print medium P to which the toner image is transferred is heated and pressed in a fusing process. In this case, an internal temperature of the image forming apparatus is increased, and an excessive increase in the internal temperature of the image forming apparatus should be avoided. Also, moisture in the print medium P may evaporate and vapor may be generated in the fusing process. The vapor may cause condensation. For example, the vapor may be condensed on a surface having a low internal temperature of the image forming apparatus such that water droplets may be formed. The water droplets may be attached to the print medium P during subsequent printing and may contaminate an image. For example, when the water droplets are formed on a surface of the second feed path 4-2, water may attach to the print medium P fed to the second feed path 4-2 for the purpose of double-sided printing. The water on the print medium P may lead to a poor image during the double-sided printing. In order to address this problem, a structure for reducing the internal temperature of the image forming apparatus and discharging the vapor to the outside of the image forming apparatus by using a blower may be employed. An example structure may be formed so that air flows through the fusing unit 2 that is a heat source.

Figure 2:
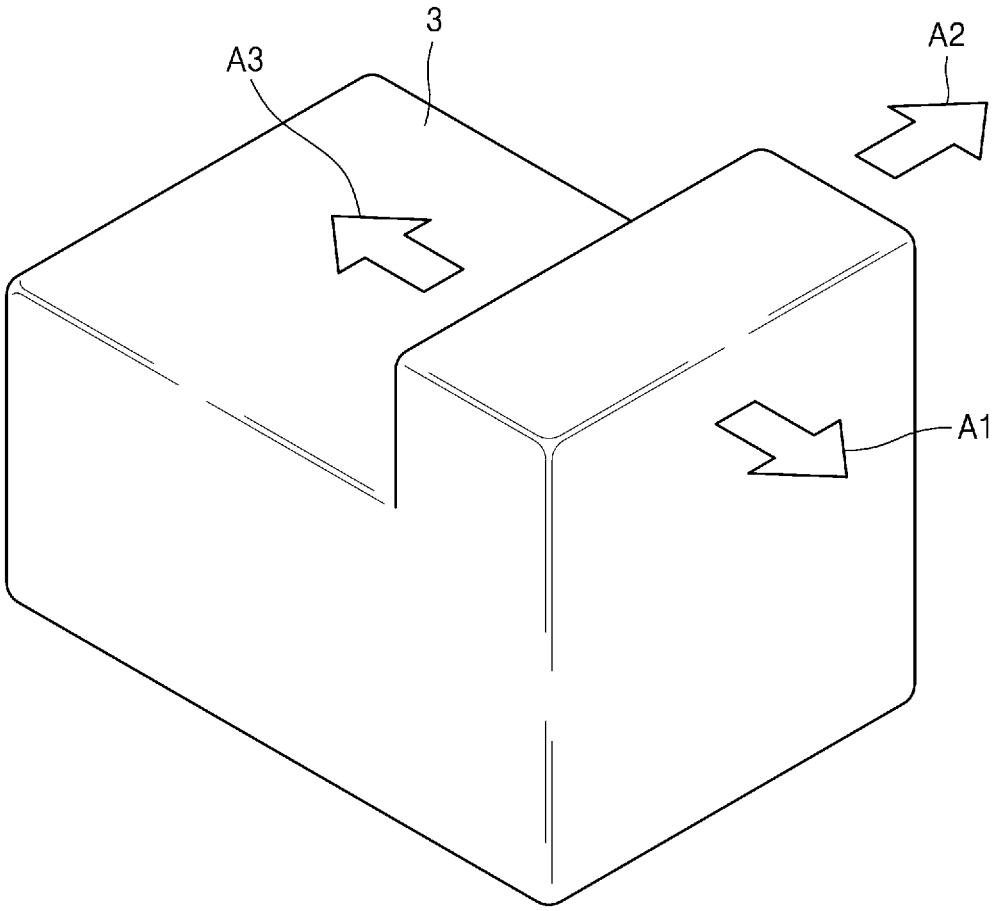
FIG. 2 is a perspective view illustrating directions of airflow due to a blower according to an example.

FIG. 2 is a perspective view illustrating directions of airflow due to a blower according to an example.

Referring to FIG. 2, a method of generating airflow in a direction A1 (a direction opposite to a discharge direction in which the print medium P is discharged) and cooling and removing vapor may be considered. In this case, air passing through the fusing unit 2 passes through the second feed path 4-2 and the double-sided printing path 5 and is discharged to the outside of the image forming apparatus. Accordingly, cooling and vapor removing effects may be reduced and the efficiency of the blower may be reduced.

A method of generating airflow in a direction A2 (a width direction of the print medium P) and cooling and removing vapor may be considered. In this case, a sufficient space for forming an air passage passing through the fusing unit 2 has to be formed around the exit of the fusing unit 2. Also, because airflow has to be generated through a long air passage extending in the width direction of the print medium P, a blower having a large capacity such as a sirocco blower is required.

According to an example, airflow is generated in a direction A3 (the discharge direction of the print medium P). To this end, as shown in FIG. 1, the first medium discharge outlet 6-1 and the second medium discharge outlet 6-2 are spaced apart from each other in the vertical direction, airflow starting from the fusing unit 2 is directed to a gap between the first medium discharge outlet 6-1 and the second medium discharge outlet 6-2, and high-temperature air and vapor are discharged through the gap between the first medium discharge outlet 6-1 and the second medium discharge outlet 6-2 to the outside of the image forming apparatus. In this configuration, because air passing through the fusing unit 2 may be discharged to the outside of the image forming apparatus without passing through feed paths of the print medium P, that is, the first feed path 4-1, the second feed path 4-2, or the double-sided printing path 5, a blower having a relatively small capacity may be used, thereby leading to improved cooling and vapor discharging effects.

Nanodust may be generated due to evaporation of a resin constituting toner or vaporization of a lubricant applied to a structure such as bearing or the like that supports a rotating member of the fusing unit 2. The nanodust needs to be filtered so as not to leak to the outside of the image forming apparatus.

An example of a cooling and purifying structure of the image forming apparatus will now be described.

Figure 3:
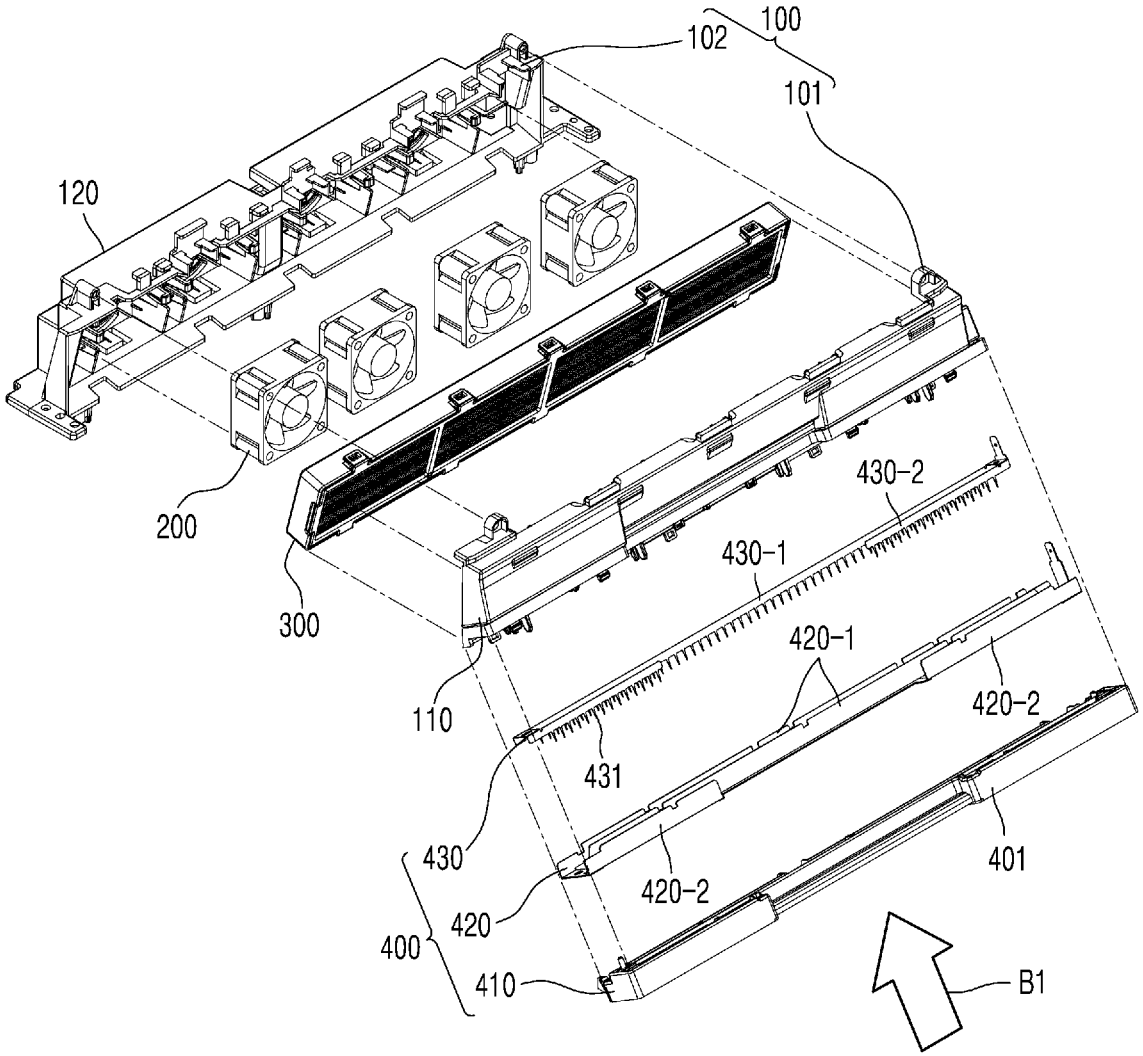
FIG. 3 is an exploded perspective view of a cooling and purifying structure according to an example.

FIG. 3 is an exploded perspective view illustrating a cooling and purifying structure according to an example.

Referring to FIGS. 1 and 3, the image forming apparatus includes a duct 100 that forms an air passage from the fusing unit 2 to the discharge outlet and a blower 200 that is provided in the duct 100. The duct 100 includes an air inlet 110 that is located adjacent to the exit of the fusing unit 2, and an air discharge outlet 120 that is located toward the discharge outlet through which the print medium P is discharged. For example, the duct 100 may form an air passage from the fusing unit 2 to the first medium discharge outlet 6-1 and the second medium discharge outlet 6-2. The duct 100 is located between the first feed path 4-1 and the second feed path 4-2. The air inlet 110 may be located adjacent to the exit of the fusing unit 2, and the air discharge outlet 120 may be open between the first medium discharge outlet 6-1 and the second medium discharge outlet 6-2. The air inlet 110 may be located adjacent to the guide member 8.

A width of the duct 100 may be greater than a width of the print medium P. In an example, the duct 100 may be formed by combining an intake cover 101 adjacent to the fusing unit 2 and including the air inlet 110 with a discharge cover 102 adjacent to the first medium discharge outlet 6-1 and the second medium discharge outlet 6-2 and including the air discharge outlet 120. The blower 200 may be located adjacent to the air discharge outlet 120. The blower 200 may be coupled to the discharge cover 102. Although four blowers 200 are arranged in the width direction in the present example, the number of blowers 200 is not limited thereto and may be less or greater than 4. The blower 200 generates airflow from the air inlet 110 to the air discharge outlet 120, and intakes air from around the fusing unit 2 and discharges the air to the air discharge outlet 120. In an example, the blower 200 may be a fan.

According to an example, the air taken in from around the fusing unit 2 is discharged through the duct 100 to the outside of the image forming apparatus. That is, the duct 100 forms a sealed airflow passage in the image forming apparatus. Accordingly, contact between the air and components inside the image forming apparatus may be minimized and efficient cooling and vapor discharging may be performed. Also, the air and vapor may be discharged to the outside of the image forming apparatus through a shortest passage from the fusing unit 2 that is a heat and vapor source. Accordingly, the blower 200 having a relatively small capacity may be employed, thereby reducing costs.

In order to reduce or prevent nanodust from leaking to the outside of the image forming apparatus, the image forming apparatus may include a filter 300 that filters the nanodust in air flowing along the duct 100. The filter 300 may be provided in the duct 100 to be located upstream of the blower 200 in a direction of airflow.

According to an example, air around the fusing unit 2 that is a nanodust source may be taken in and discharged through the filter 300 to the outside of the image forming apparatus. Accordingly, contamination of the inside of the image forming apparatus due to nanodust may be reduced or prevented.

In order to improve a nanodust filtering effect, the image forming apparatus may include an ionizer 400. The ionizer 400 charges the nanodust and causes particles of the nanodust to be attached to one another. Accordingly, the nanodust may be more easily filtered by the filter 300. In an example, the filter 300 may be an electrostatic filter. The ionizer 400 may be provided at the air inlet 110 of the duct 100.

The ionizer 400 may include a plate electrode 420 extending in the width direction of the print medium P and a counter electrode 430 facing the plate electrode 420. The plate electrode 420 and the counter electrode 430 may be provided on a frame 410. The counter electrode 430 includes a plurality of needle electrodes 431 that are arranged in the width direction of the print medium P. The plurality of needle electrodes 431 may be arranged over the entire width direction of the print medium P.

The plate electrode 420 may be a cathode, and the counter electrode 430 may be an anode. When a high voltage, for example, 30 KV, is applied to the plate electrode 420 and the counter electrode 430, a discharge occurs between the plate electrode 420 and the needle electrodes 431 and ambient air is ionized. Accordingly, when the air passes through the ionizer 400, nanodust included in the air is charged and particles of the nanodust are attached to one another to be polymerized. When the nanodust is polymerized, it means that particles of the nanodust are attached to one another to increase a size. Accordingly, the nanodust may be more easily collected by the filter 300. Also, when an electrostatic filter is used as the filter 300, the charged nanodust may be more easily collected by the filter 300.

Figure 4:
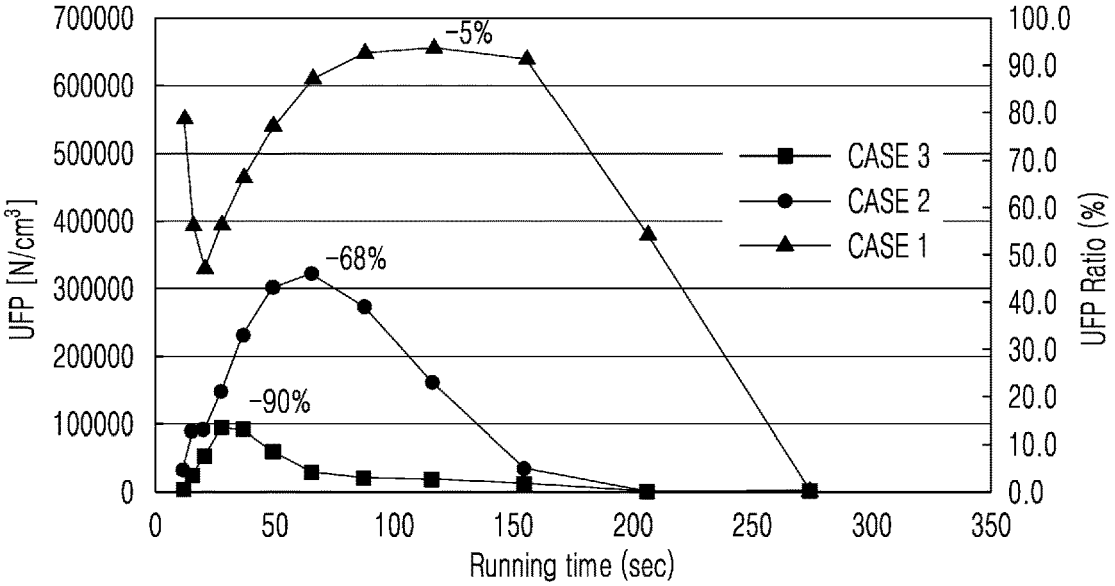
FIG. 4 is a graph illustrating an air purifying effect corresponding to a direction of airflow according to an example.

FIG. 4 is a graph illustrating an air purifying effect according to a direction of airflow according to an example.

Referring to FIG. 4, the horizontal axis represents a running time of the image forming apparatus and the vertical axis represents a ratio of an amount (e.g., a number of particles of nanodust per cubic centimeter, $N/cm^3$) of nanodust per unit volume of air ejected to the outside of the image forming apparatus. The ratio of the nanodust is a ratio assuming that $700{,}000/cm^3$ is 100%. In FIG. 4, CASE 1, CASE 2, and CASE 3 are cases where airflow is respectively generated in the directions A1, A2, and A3 in FIG. 2. In FIG. 4, UFP denotes ultrafine particles.

In CASE 1, about 5% of nanodust is filtered about 150 seconds after an operation starts. In CASE 2, about 68% of nanodust is filtered about 100 seconds after an operation starts. In CASE 3, about 90% of nanodust is filtered about 30 seconds after an operation starts. As such, according to a cooling and purifying structure of the present example in which airflow is generated in the direction A3 and air is discharged from the fusing unit 2 through a gap between the first medium discharge outlet 6-1 and the second medium discharge outlet 6-2 to the outside of the image forming apparatus, nanodust may be filtered most efficiently of the three directions A1, A2, and A3.

Referring again to FIG. 3, the ionizer 400 may be located parallel to a direction B1 of air flowing from the exit of the fusing unit 2 to the air inlet 110 of the duct 100. In other words, the ionizer 400 is located so that an opening surface 401 of the ionizer 400 is perpendicular to the direction B1 of the air flowing from the exit of the fusing unit 2 to the air inlet 110 of the duct 100. In this case, the plate electrode 420 and the counter electrode 430 are parallel to the direction B1 of the air flow. In this configuration, because a plasma network formed by the plate electrode 420 and the counter electrode 430 is perpendicular to the direction B1 of the air flow, a contact probability between fine particles in the air and the plasma network may be increased and nanodust may be effectively charged. Accordingly, an air purifying effect may be improved.

Figure 5:
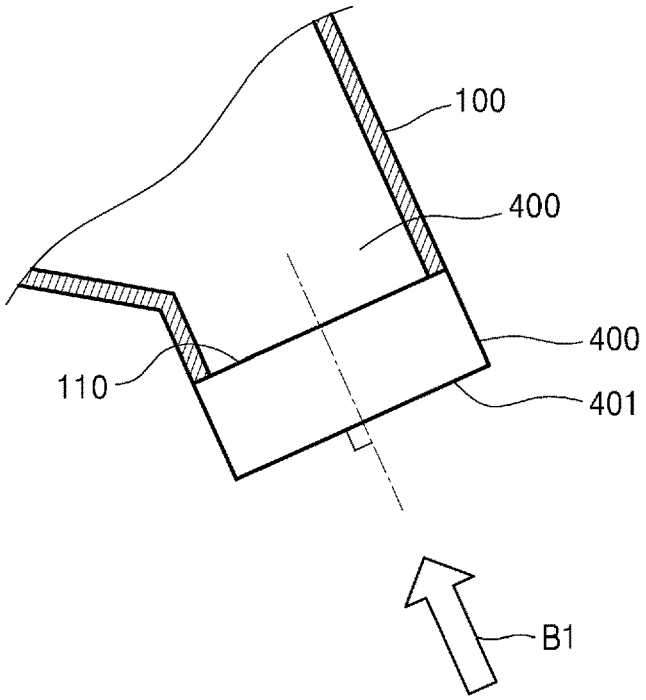
FIG. 5 is a view illustrating an arrangement of an ionizer in which an opening surface of the ionizer and a direction of air flowing from a fusing unit are perpendicular to each other according to an example.
Figure 6:
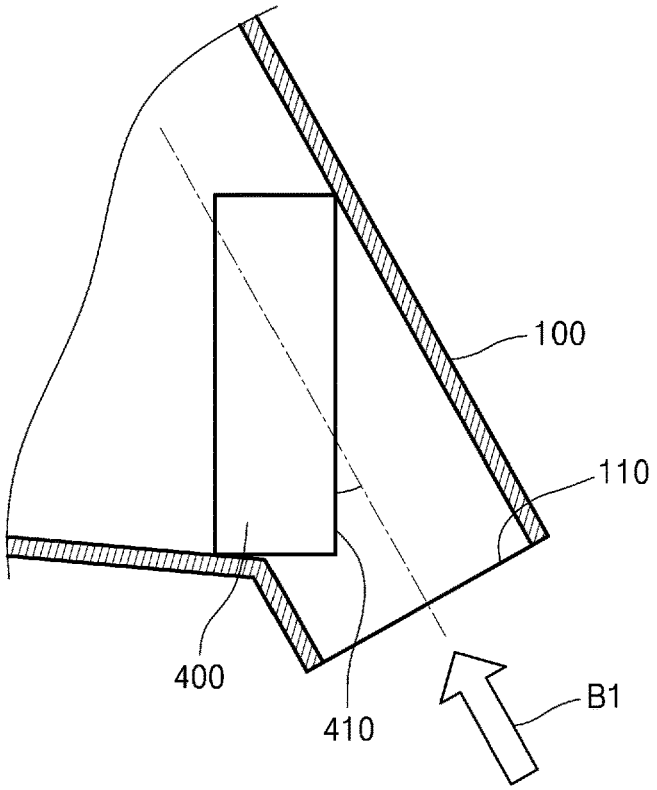
FIG. 6 is a view illustrating an arrangement of an ionizer in which an opening surface of the ionizer and a direction of air flowing from a fusing unit form an acute angle according to an example.
Figure 7:
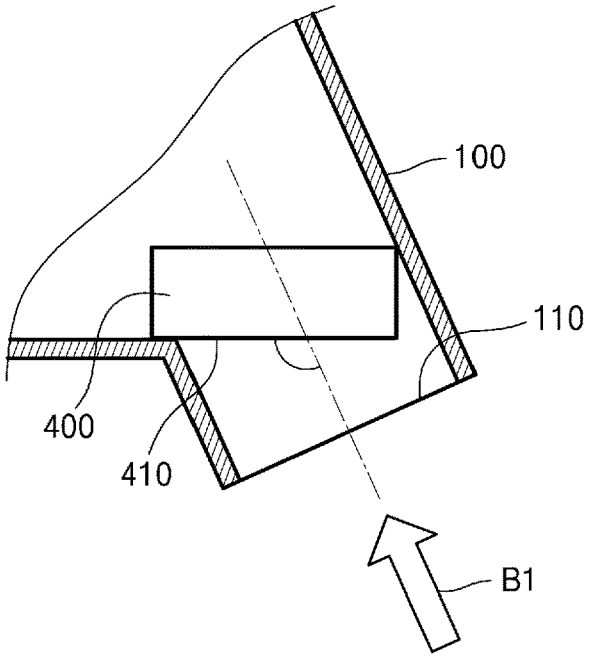
FIG. 7 is a view illustrating an arrangement of an ionizer in which an opening surface of the ionizer and a direction of air flowing from a fusing unit form an obtuse angle according to an example.

FIG. 5 is a view illustrating an arrangement of an ionizer in which an opening surface of the ionizer and a direction of air flowing from a fusing unit are perpendicular to each other according to an example. FIG. 6 is a view illustrating an arrangement of an ionizer in which an opening surface of an ionizer and a direction of air flowing from a fusing unit form an acute angle according to an example. FIG. 7 is a view illustrating an arrangement of an ionizer in which an opening surface of the ionizer and a direction of air flowing from a fusing unit form an obtuse angle according to an example.

Referring to FIG. 5, the opening surface 401 of the ionizer 400 is perpendicular to the direction B1 of air flowing from the exit of the fusing unit 2 to the air inlet 110 of the duct 100. Referring to FIG. 6, the opening surface 401 of the ionizer 400 and the direction B1 of the air flowing from the exit of the fusing unit 2 to the air inlet 110 of the duct 100 form an acute angle. Referring to FIG. 7, the opening surface 401 of the ionizer 400 and the direction B1 of the air flowing from the exit of the fusing unit 2 to the air inlet 110 of the duct 100 form an obtuse angle.

Figure 8:
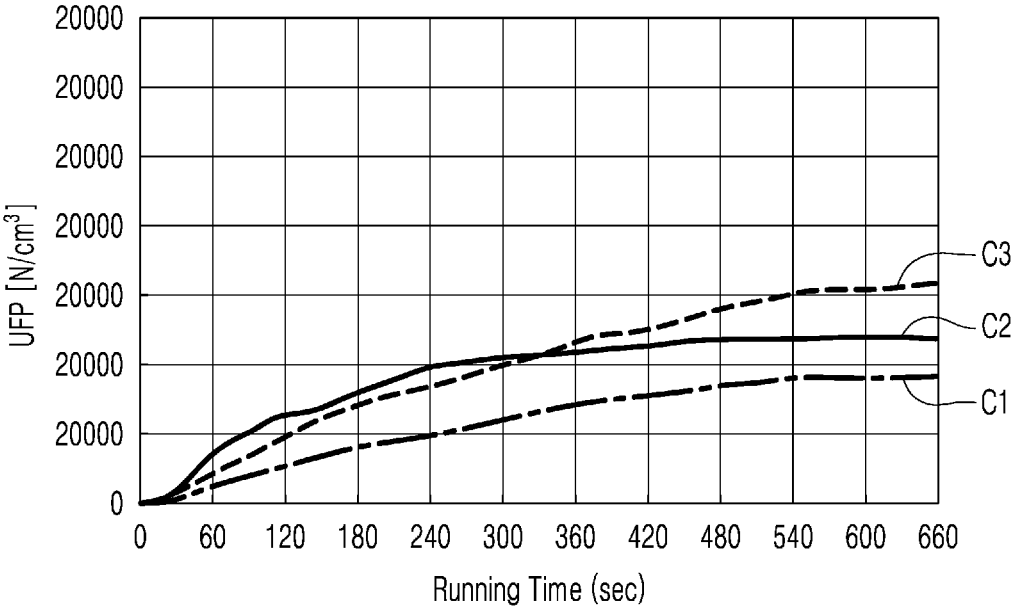
FIG. 8 is a graph illustrating a relationship between an arrangement of the ionizer of each of FIGS. 5, 6, and 7 and an air purifying effect according to an example.

FIG. 8 is a graph illustrating a relationship between an arrangement of the ionizer of each of FIGS. 5, 6, and 7 and an air purifying effect according to an example.

Referring to FIG. 8, the horizontal axis represents a running time and the vertical axis represents an amount ($N/cm^3$) of nanodust per unit volume of air ejected to the outside of the image forming apparatus. In FIG. 8, C1, C2, and C3 respectively correspond to arrangements of the ionizer 400 of FIGS. 5, 6, and 7. As illustrated in FIG. 8, it is found that according to an arrangement in which the opening surface 401 of the ionizer 400 and the direction B1 of air flowing from the exit of the fusing unit 2 to the air inlet 110 of the duct 100 are perpendicular to each other (i.e., the arrangement of FIG. 5), nanodust may be most effectively filtered.

Figure 9:
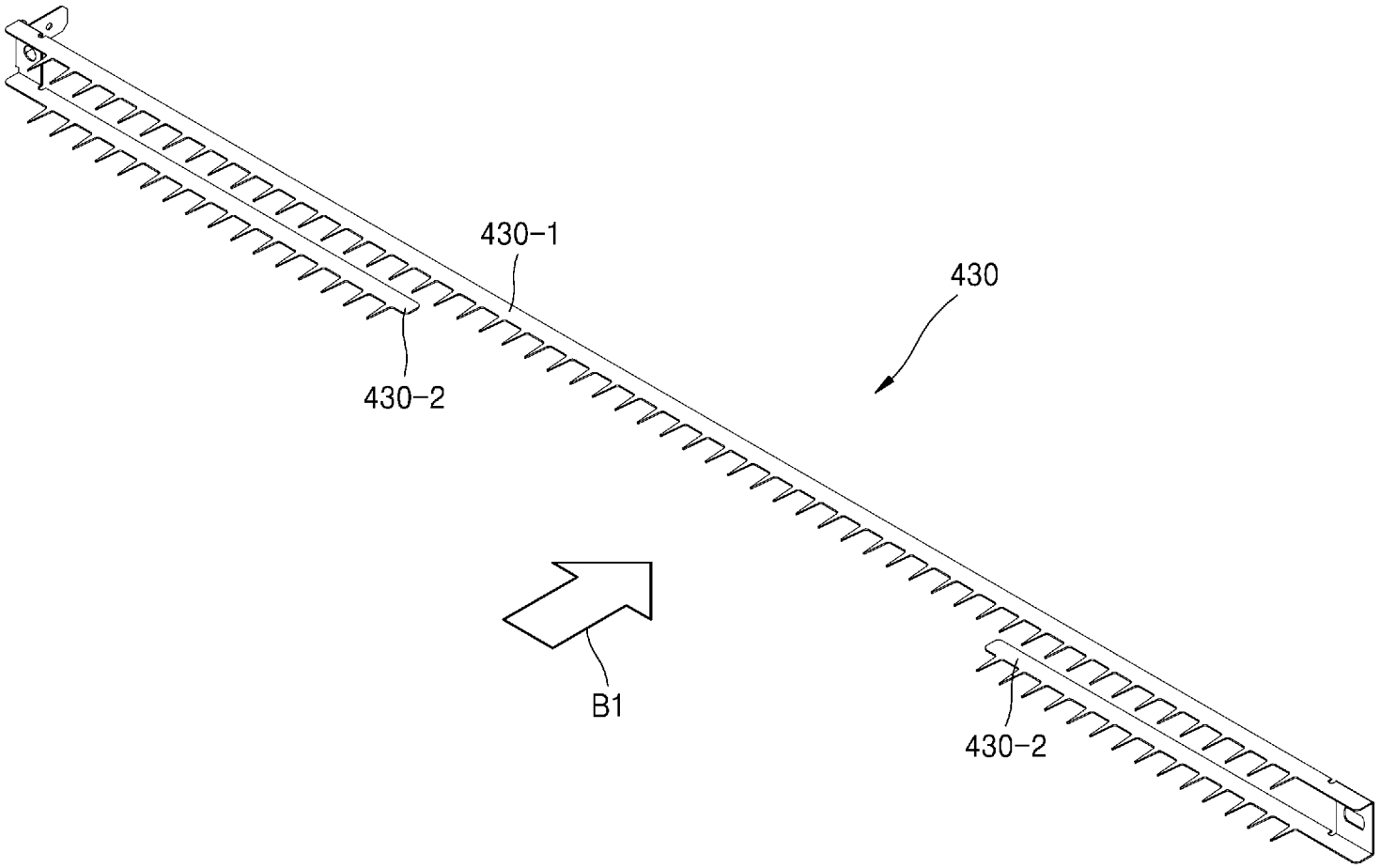
FIG. 9 is a perspective view of a counter electrode according to an example.

FIG. 9 is a perspective view of a counter electrode according to an example.

Referring to FIG. 9, the counter electrode 430 may include a first counter electrode 430-1 extending over the entire width direction of the print medium P, and at least one second counter electrode 430-2 parallel to the first counter electrode 430-1 and located at a side in the width direction of the print medium P. The first counter electrode 430-1 and the second counter electrode 430-2 may be spaced apart from each other in a direction perpendicular to the direction B1 of the air flow. A length of the second counter electrode 430-2 is not limited.

The first counter electrode 430-1 and the second counter electrode 430-2 may be connected to each other in an alternating or a zigzag fashion. In this configuration, an electrical structure for applying a voltage may be simplified. As shown in FIG. 3, the plate electrode 420 may include a first plate electrode 420-1 corresponding to the first counter electrode 430-1 and a second plate electrode 420-2 corresponding to the second counter electrode 430-2.

A lubricant may be supplied to a bearing that supports end portions of a rotating member of the fusing unit 2, for example, a fusing roller or a fusing belt. When the lubricant is heated and evaporates, nanodust may be generated. The nanodust due to the lubricant may be mostly generated in areas corresponding to ends in the width direction of the print medium P. When the second counter electrode 430-2 is additionally located as shown in FIG. 4, a greater plasma network may be formed in the areas corresponding to the ends in the width direction of the print medium P and the nanodust due to the lubricant may be sufficiently charged. Accordingly, air purifying efficiency may be improved.

Figure 10:
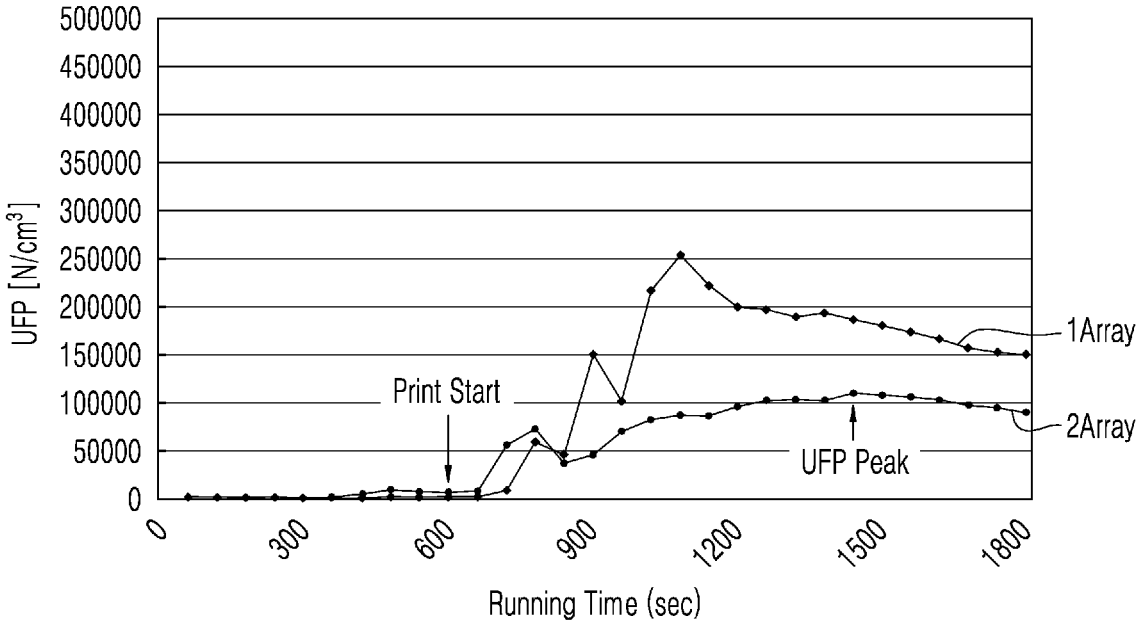
FIG. 10 is a graph illustrating air purifying efficiency corresponding to a type of a counter electrode according to an example.

FIG. 10 is a graph illustrating air purifying efficiency corresponding to a type of a counter electrode according to an example.

Referring to FIG. 10, the horizontal axis represents a running time and the vertical axis represents an amount ($N/cm^3$) of nanodust per unit volume of air ejected to the outside of the image forming apparatus. In FIG. 10, 1Array and 2Array respectively correspond to a case where the first counter electrode 430-1 is provided and a case where the first counter electrode 430-1 and the second counter electrode 430-2 are provided. Referring to FIG. 10, it is found that when the first counter electrode 430-1 and the second counter electrode 430-2 are provided, a peak value of nanodust may be reduced by about 62%.

A structure of the counter electrode 430 is not limited to that of FIG. 9.

Figure 11:
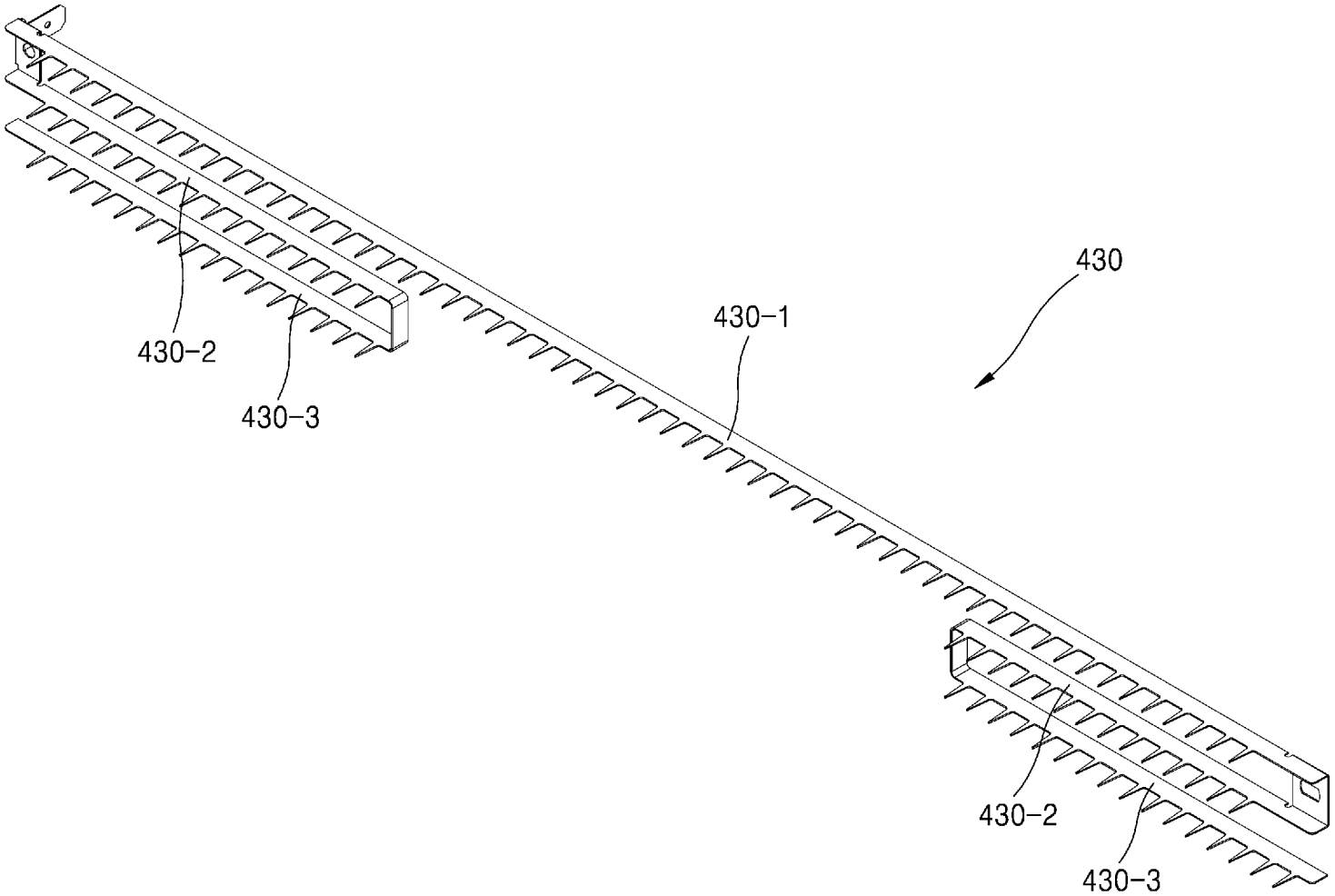
FIG. 11 is a perspective view of a counter electrode according to an example.
Figure 12:
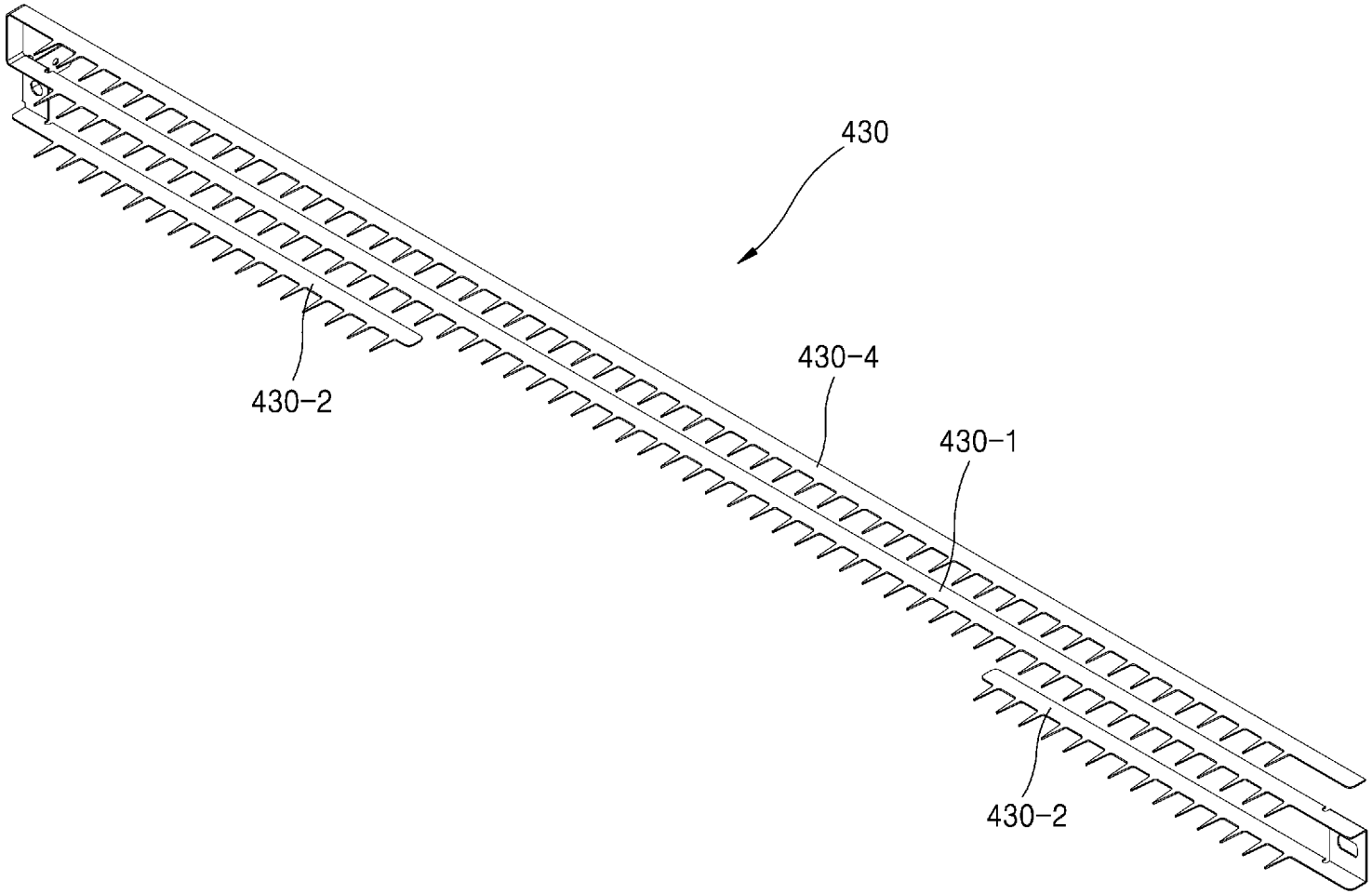
FIG. 12 is a perspective view of a counter electrode according to an example.
Figure 13:
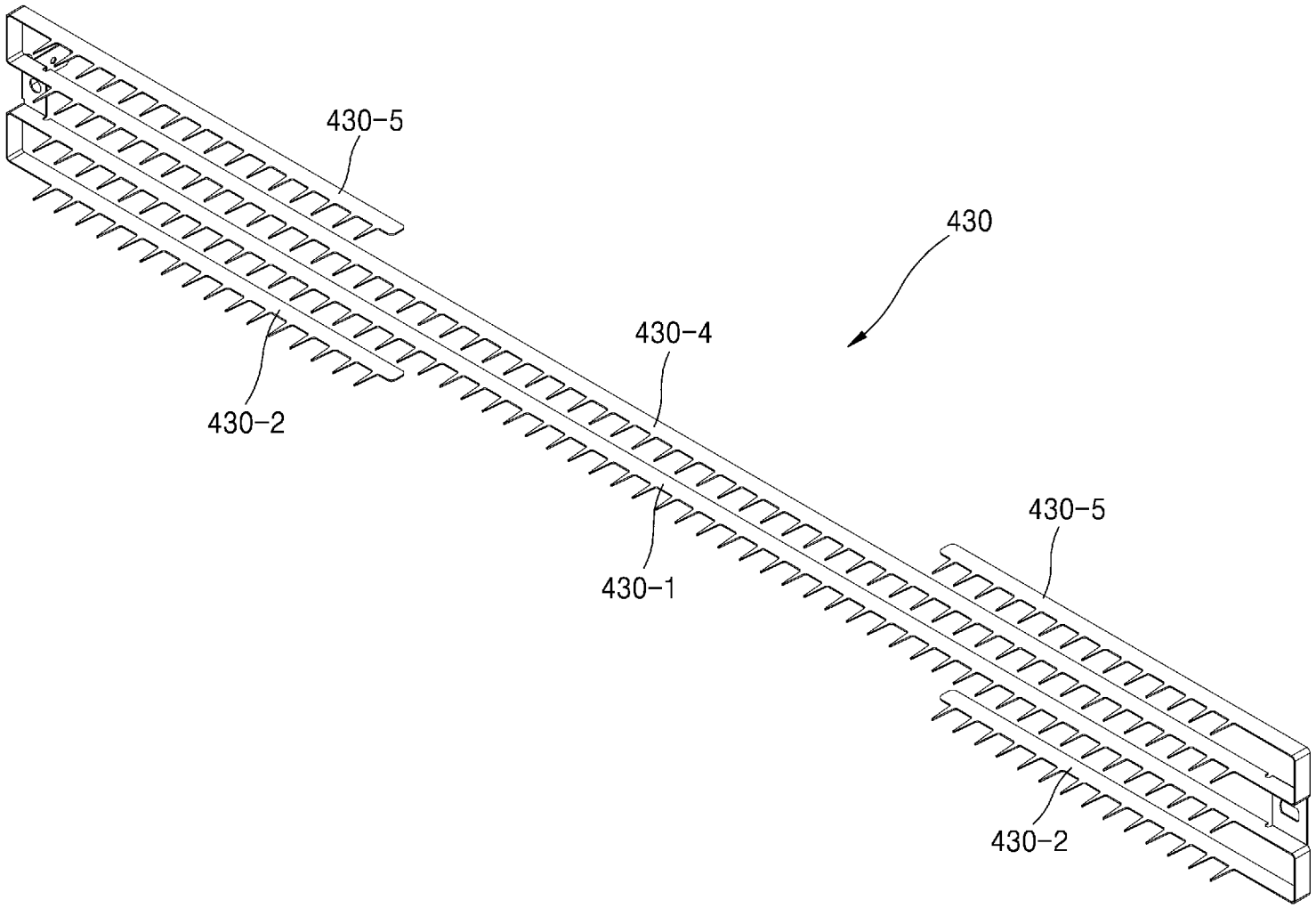
FIG. 13 is a perspective view of a counter electrode according to an example.

FIG. 11, FIG. 12, and FIG. 13 are perspective views of a counter electrode according to various examples.

Referring to FIG. 11, the counter electrode 430 may include one first counter electrode 430-1, and two second counter electrodes 430-2 and 430-3. Referring to FIG. 12, the counter electrode 430 may include two first counter electrodes 430-1 and 430-4 and one second counter electrode 430-2. Referring to FIG. 13, the counter electrode 430 may include two first counter electrodes 430-1 and 430-4 and two second counter electrodes 430-2 and 430-5. The counter electrode 430 may be of any of various other types, and the plate electrode 420 may be of any of various types according to a type of the counter electrode 430.

As described above, an air purifier may be provided in an image forming apparatus. The air purifier may include the duct 100 that includes the air inlet 110 and the air discharge outlet 120, the ionizer 400 that is provided at the air inlet 110 and charges nanodust, the blower 200 that is provided adjacent to the air discharge outlet 120 and discharges air to the air discharge outlet 120, and the filter 300 that is located between the ionizer 400 and the blower 200 and collects nanodust. Structures and functions of the duct 100, the blower 200, the filter 300, and the ionizer 400 constituting the air purifier are the same as those described above.

While the disclosure has been shown and described with reference to examples thereof, it will be understood that various changes in form and details may be made therein. Accordingly, the technical scope of the disclosure is defined by the appended claims.

What is claimed is:

1. An image forming apparatus comprising:

an image forming unit to form a toner image on a print medium;

a fusing unit to fix the toner image to the print medium;

a duct comprising an air inlet located adjacent to an exit of the fusing unit and an air discharge outlet located toward a discharge outlet through which the print medium is discharged;

an ionizer provided at the air inlet to charge nanodust; and a blower provided in the duct to discharge air to the air discharge outlet, wherein the ionizer comprises a plate electrode extending in a width direction of the print medium, and a counter electrode comprising a plurality of needle electrodes arranged in the width direction of the print medium and facing the plate electrode, the counter electrode including a first counter electrode extending over an entire width direction of the print medium and at least one second counter electrode parallel to the first counter electrode and located at a side in the width direction of the print medium.

2. The image forming apparatus of claim 1, further comprising:

a first feed path to guide the print medium passing through the fusing unit to a first medium discharge outlet; and a second feed path branched from the first feed path to guide the print medium passing through the fusing unit to a second medium discharge outlet located over the first medium discharge outlet, wherein the duct is located between the first feed path and the second feed path, and wherein the air discharge outlet is located between the first medium discharge outlet and the second medium discharge outlet.

3. The image forming apparatus of claim 2, further comprising a guide member located at the exit of the fusing unit to selectively guide the print medium to the first feed path or the second feed path.

4. The image forming apparatus of claim 1, further comprising a filter provided in the duct to collect nanodust.

5. The image forming apparatus of claim 1, wherein the first counter electrode and the at least one second counter electrode are connected in a zigzag fashion.

6. The image forming apparatus of claim 1, wherein the ionizer is located parallel to a direction of air flowing from the fusing unit to the air inlet.

7. The image forming apparatus of claim 1, further comprising:

a first medium discharge outlet and a second medium discharge outlet to allow the print medium passing through the fusing unit to be discharged therethrough and spaced apart from each other in a vertical direction; and a guide member located at the exit of the fusing unit to selectively guide the print medium to the first medium discharge outlet or the second medium discharge outlet, wherein the air inlet is located adjacent to the guide member, and wherein the air discharge outlet is located between the first medium discharge outlet and the second medium discharge outlet.

8. The image forming apparatus of claim 7, further comprising:

a filter located between the blower and the ionizer to collect dust, wherein the ionizer is to emit an electric charge.

9. The image forming apparatus of claim 8, wherein the ionizer is located parallel to a direction of air flowing from the fusing unit to the air inlet.

10. The image forming apparatus of claim 1, wherein the plate electrode includes a first plate electrode corresponding to the first counter electrode and a second plate electrode corresponding to the at least one second counter electrode.

11. An air purifier of an image forming apparatus, the air purifier comprising:

a duct comprising an air inlet and an air discharge outlet;

an ionizer provided at the air inlet to charge nanodust;

a blower provided adjacent to the air discharge outlet to discharge air to the air discharge outlet; and a filter located between the ionizer and the blower to collect the nanodust, wherein the ionizer comprises a plate electrode extending in a width direction and a counter electrode comprising a plurality of needle electrodes arranged in the width direction and facing the plate electrode, the counter electrode including at least one first counter electrode extending over an entire width direction and at least one second counter electrode parallel to the first counter electrode and located at a side in the width direction.

12. The air purifier of claim 11, wherein the at least one first counter electrode and the at least one second counter electrode are connected in a zigzag fashion.

13. The air purifier of claim 11, wherein the plate electrode includes a first plate electrode corresponding to the at least one first counter electrode and a second plate electrode corresponding to the at least one second counter electrode.

14. An image forming apparatus comprising:

an image forming unit to form a toner image on a print medium;

a fusing unit to fix the toner image to the print medium;

a duct comprising an air inlet located adjacent to an exit of the fusing unit and an air discharge outlet located toward a discharge outlet through which the print medium is discharged;

a blower provided in the duct to discharge air to the air discharge outlet;

a first feed path to guide the print medium passing through the fusing unit to a first medium discharge outlet; and a second feed path branched from the first feed path to guide the print medium passing through the fusing unit to a second medium discharge outlet located over the first medium discharge outlet, wherein the air inlet of the duct is located between the first feed path and the second feed path, and wherein the air discharge outlet is located between the first medium discharge outlet and the second medium discharge outlet.

15. The image forming apparatus of claim 14, further comprising a guide member located at the exit of the fusing unit to selectively guide the print medium to the first feed path or the second feed path.

16. The image forming apparatus of claim 14, further comprising a filter provided in the duct to collect nanodust.

17. The image forming apparatus of claim 14, further comprising an ionizer provided at the air inlet to charge nanodust.

18. The image forming apparatus of claim 17, wherein the ionizer comprises a plate electrode extending in a width direction of the print medium, and a counter electrode comprising a plurality of needle electrodes arranged in the width direction of the print medium and facing the plate electrode.

19. The image forming apparatus of claim 18, wherein the counter electrode comprises:

a first counter electrode extending over an entire width direction of the print medium; and at least one second counter electrode parallel to the first counter electrode and located at a side in the width direction of the print medium.

20. The image forming apparatus of claim 19, wherein the first counter electrode and the at least one second counter electrode are connected in a zigzag fashion.

* * * * *